US010954907B2

(12) United States Patent
De Luca et al.

(10) Patent No.: US 10,954,907 B2
(45) Date of Patent: Mar. 23, 2021

(54) PUMP UNIT FOR FEEDING FUEL, PREFERABLY DIESEL FUEL, TO AN INTERNAL COMBUSTION ENGINE

(71) Applicant: Robert Bosch GmbH, Stuttgart (DE)

(72) Inventors: Alessandro De Luca, Palese Macchie-Bari (IT); Luigi Fiorentino, Modugno (IT); Ottavio Corizzo, Rolla Imperiale (IT); Tobias Reiser, Ehningen (DE); Valeria Cecilia Belgiovine, Modugno (IT)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/474,255

(22) PCT Filed: Dec. 15, 2017

(86) PCT No.: PCT/EP2017/083015

§ 371 (c)(1),
(2) Date: Jun. 27, 2019

(87) PCT Pub. No.: WO2018/122005

PCT Pub. Date: Jul. 5, 2018

(65) Prior Publication Data

US 2020/0124008 A1 Apr. 23, 2020

(30) Foreign Application Priority Data

Dec. 27, 2016 (IT) ..... 102016000131338

(51) Int. Cl.
*F02M 59/46* (2006.01)
*F04C 15/06* (2006.01)
(Continued)

(52) U.S. Cl.
CPC ..... *F02M 59/462* (2013.01); *F04B 53/10* (2013.01); *F04C 15/064* (2013.01);
(Continued)

(58) Field of Classification Search
CPC .... F02M 59/462; F02M 59/102; F02M 59/44; F02M 2200/02; F02M 2200/04;
(Continued)

(56) References Cited

U.S. PATENT DOCUMENTS 4,829,967 A 5/1989 Nuti
2003/0209226 A1 11/2003 Smith
(Continued)

FOREIGN PATENT DOCUMENTS

DE 4037465 5/1992
DE 102010039501 2/2012
(Continued)

OTHER PUBLICATIONS

International Search Report for Application No. PCT/EP2017/083015 dated Apr. 12, 2018 (English Translation, 3 pages).

*Primary Examiner* — Mahmoud Gimie
(74) *Attorney, Agent, or Firm* — Michael Best & Friedrich LLP

(57) ABSTRACT

The invention relates to a pump unit for feeding fuel, preferably diesel fuel, to an internal combustion engine, comprising at least one cylinder (14), a piston (15) which is displaceably arranged in the cylinder (14), and a pressure valve (30) for selectively controlling the supply of fuel to the internal combustion engine, wherein the pressure valve (30) has a closure part (38, 46, 51) provided with a cavity (44, 49, 53) that opens to the outside on an end surface (43, 48, 52) facing the piston (15) of the closure part (38, 46, 51).

14 Claims, 3 Drawing Sheets

(51) Int. Cl.
*F04B 53/10* (2006.01)
*F04B 1/0421* (2020.01)
*F04B 1/0452* (2020.01)

(52) U.S. Cl.
CPC ..... *F02M 2200/02* (2013.01); *F02M 2200/04* (2013.01); *F04B 1/0421* (2013.01); *F04B 1/0452* (2013.01)

(58) Field of Classification Search
CPC ..... F04B 1/0421; F04B 1/0452; F04B 53/10; F04C 15/064
USPC ..... 123/506, 508
See application file for complete search history.

(56) References Cited

U.S. PATENT DOCUMENTS

| | | | | |
|---|---|---|---|---|
| 2006/0048755 | A1* | 3/2006 | Kamiyama | F02M 39/02 123/508 |
| 2013/0240773 | A1* | 9/2013 | Zimmermann | B60T 8/4031 251/318 |

FOREIGN PATENT DOCUMENTS

| | | | |
|---|---|---|---|
| EP | 0209938 | | 1/1987 |
| EP | 1857667 | | 11/2007 |
| JP | 105248319 | | 9/1993 |
| JP | 2005248319 | A | 9/2005 |
| JP | 2006507446 | A | 3/2006 |
| JP | 6248319 | A | 7/2013 |
| WO | 2010130502 | | 11/2010 |
| WO | 2015091264 | | 6/2015 |

* cited by examiner

PUMP UNIT FOR FEEDING FUEL, PREFERABLY DIESEL FUEL, TO AN INTERNAL COMBUSTION ENGINE

BACKGROUND OF THE INVENTION

The present invention relates to a pump unit for feeding fuel, preferably diesel, to an internal combustion engine.

In particular, the present invention relates to a pump unit of the type which comprises a pump body, at least one cylinder formed in the pump body, a piston arranged displaceably in the cylinder, and an actuating device for moving the piston with an intake stroke for the intake of the fuel into the cylinder, and with a compression stroke for the compression of the fuel contained in the cylinder.

The pump unit also comprises a suction line for the intake of the fuel into the cylinder, a suction valve, which is fitted along the suction line, for selectively controlling the feeding of the fuel into the cylinder, a pressure line for the pushing of the fuel to the internal combustion engine, and a pressure valve, which is fitted along the pressure line, for selectively controlling the feeding of the fuel to the internal combustion engine.

The pressure line runs in a manner coaxial with a longitudinal axis of the cylinder, and a closure part of the pressure valve is arranged displaceably in said pressure line.

The closure part of the pressure valve thus axially faces the piston and is movable between an open position and a closed position of the pressure line.

The closure part has a substantially ball-shaped coupling portion, which is shaped such that it is coupled in a fluid-tight manner to a substantially frustoconical coupling portion of the pressure line when the closure part is in its closed position.

The known pump units of the aforementioned type have a number of disadvantages, these mainly being based on the fact that, during its compression stroke, the piston generates in the interior of the cylinder pressure waves which bounce off between the closure part of the pressure valve and the piston parallel to the longitudinal axis of the cylinder at least during the starting phase of the compression stroke of the piston, that is to say when the pressure valve is still closed.

The back-and-forth movement of the pressure waves between the closure part and the piston brings about the formation of vapor bubbles and the implosion thereof at the coupling portions of the closure part and of the pressure line.

The implosion of the vapor bubbles leads, as a result of cavitation, to the wear of the closure part and of the pressure line at the respective coupling portions and consequently impairs the correct fluid-tight coupling of the closure part to the pressure line.

SUMMARY OF THE INVENTION

It is the object of the present invention to embody a pump unit for feeding fuel, preferably diesel, to an internal combustion engine, which pump unit does not have the above-described disadvantages and is simple and favorable in terms of its embodiment.

According to the present invention, a pump unit for feeding fuel, preferably diesel, to an internal combustion engine is embodied.

BRIEF DESCRIPTION OF THE DRAWINGS

The present invention will now be described with reference to the appended drawings, which illustrate an embodiment that does not restrict the invention and in which.

DETAILED DESCRIPTION

Figure 1:
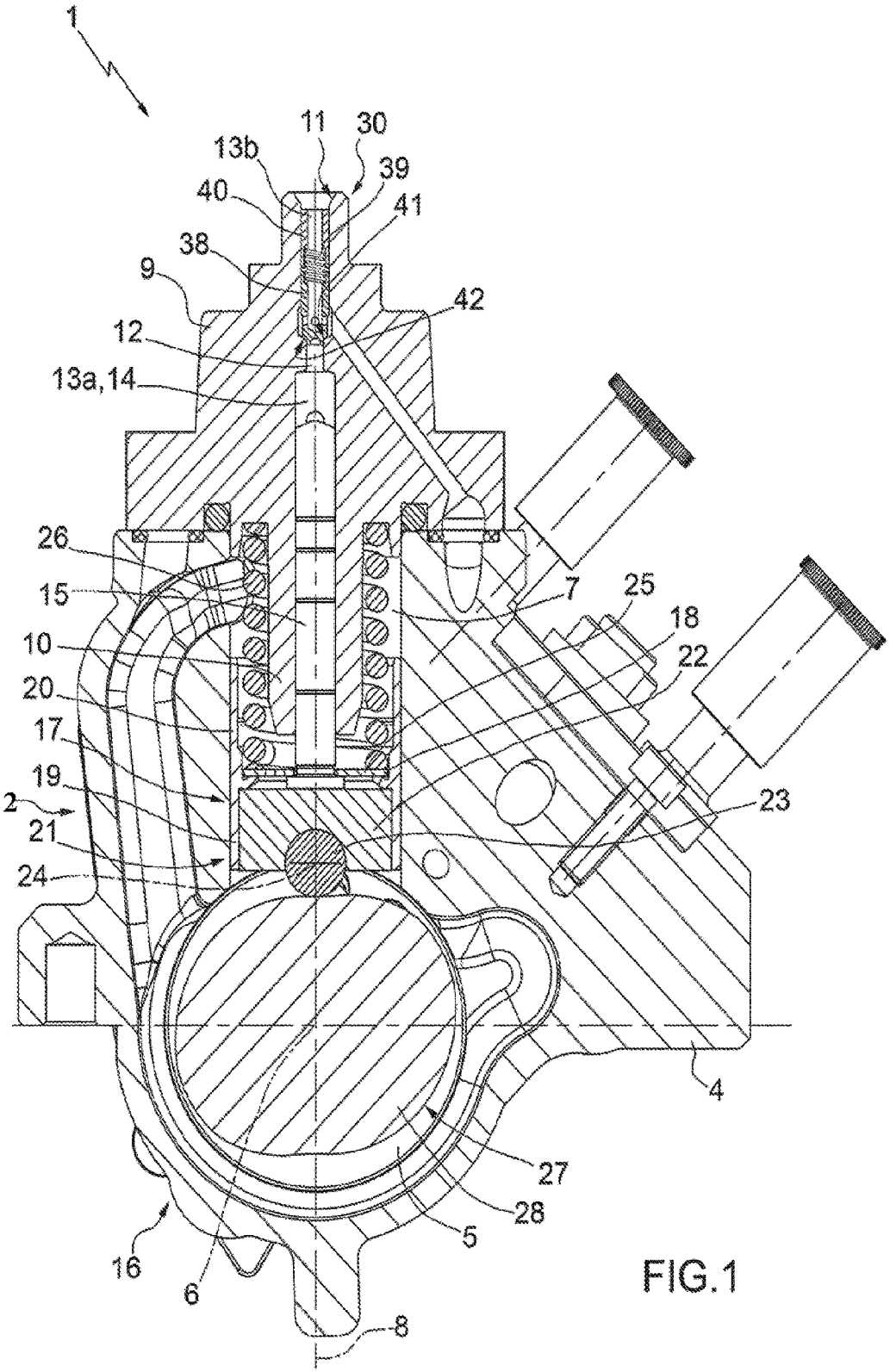
FIG. 1 shows a first schematic sectional view, with parts omitted for clarity, of a preferred embodiment of the pump unit according to the invention.
Figure 2:
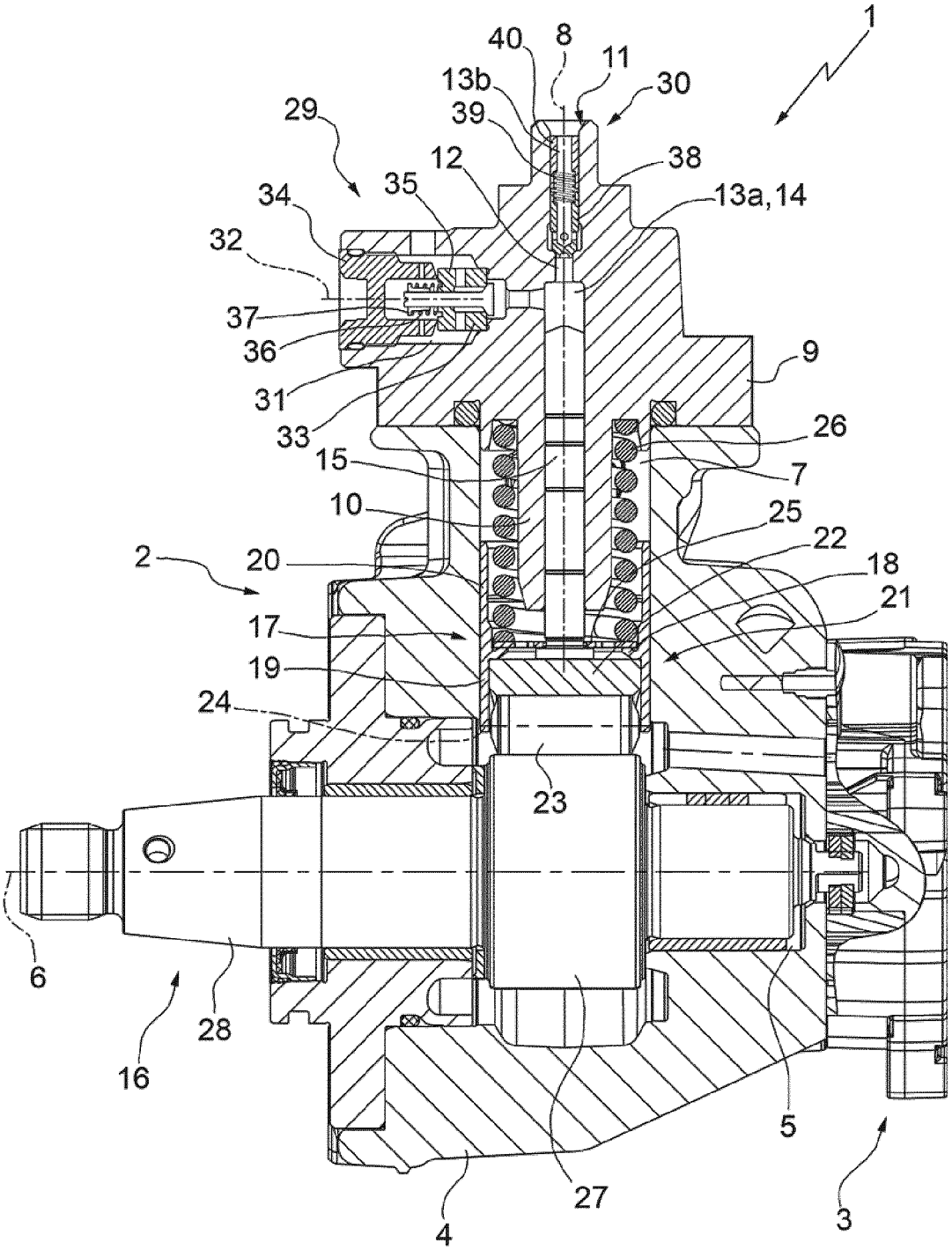
FIG. 2 shows a second schematic sectional view, with parts omitted for clarity, of the pump unit from FIG. 1.

With reference to FIGS. 1 and 2, a pump unit for feeding fuel, preferably diesel, to an internal combustion engine (not illustrated) is denoted as a whole by 1.

The pump unit 1 comprises a piston pump 2 for feeding the fuel to said internal combustion engine (not illustrated), and a predelivery pump 3, for example a gearwheel pump, for feeding the fuel to the pump 2.

The pump unit 1 has a pump body, which comprises a housing 4 that is provided with a central bore 5, having a longitudinal axis 6, and with at least one lateral bore 7 (normally a multiplicity of bores 7 which are distributed uniformly around the axis 6), having a longitudinal axis 8, which runs transversely with respect to the axis 6 and extends from the bore 5 radially to the outside of the housing 4.

Each bore 7 is closed off by a head part 9 which is arranged so as to be in contact with the housing 4 and which has an extension 10 which projects into the bore 7 in a manner coaxial with the axis 8.

The head part 9 has a central bore 11 which is formed through the head part 9 in a manner coaxial with the axis 8, and comprises a constricted intermediate portion 12 which is arranged between two widened portions 13*a*, 13*b*, wherein the portion 13*a* faces the bore 5 and defines a cylinder 14 of the piston pump 2.

Arranged displaceably in the cylinder 14 is a piston 15 which is movable under the thrust of an actuating device 16 with a rectilinear back-and-forth movement, this comprising a suction stroke for the intake of the fuel into the cylinder 14 and a compression stroke for the compression of the fuel contained in the cylinder 14.

The device 16 comprises a tubular sleeve 17 which is arranged displaceably in the bore 7 in a manner coaxial with the axis 8, which extends around the cylinder 14 and which has a ring-shaped inner flange 18 projecting radially from an inner surface of the sleeve 17 and dividing said sleeve 17 into two cylindrical portions 19, 20, wherein the portion 19 faces the bore 5.

The device 16 also has a tappet 21 which comprises a substantially cylindrical coupling block 22, said coupling block being secured in the portion 19 as a result of overdimensioning, being arranged so as to be in contact with the flange 18 and supporting a tappet roller 23.

The roller 23 projects from the block 22 to the bore 5 and is rotatably coupled to the block 22 in order to rotate about its own longitudinal axis 24 with respect to said block 22, which longitudinal axis runs substantially perpendicular to the axis 8.

The flange 18 supports a ring-shaped plate 25 which extends around the piston 15, which is inserted into the portion 20 of the sleeve 17 in a manner coaxial with the axis 8 and which has an outer circumferential edge which axially faces the flange 18 and an inner circumferential edge which axially faces a base of the piston 15.

The device 16 also comprises a compression spring 26 which is fitted between the extension 10 and the sleeve 17 in a manner coaxial with the axis 8 and which is seated between the head part 9 and the plate 25 in order to move the plate 25 in contact with the flange 18, and normally to keep it in contact therewith, and to move the roller 23 in contact with a cam 27, and normally to keep it in contact therewith, said cam being formed on an outer surface of an intermediate portion of a drive shaft 28 which is fitted through the bore 5 in order to rotate about the axis 6 with respect to the housing 4.

The head part 9 accommodates in its interior a suction valve 29 for sucking the fuel into the cylinder 14, and a pressure valve 30 for pushing the fuel to the internal combustion engine (not illustrated).

The valve 29 is fitted in a suction line 31 which has a longitudinal axis 32, which runs perpendicular to the axis 8, and comprises a cylindrical valve body 33 which extends around the axis 32 and which is axially secured along the line 31 by a closure cover 34 which is screwed into the line 31.

The valve 29 also comprises a closure part 35 which is fitted through the valve body 33 in order to move between an open position and a closed position of the valve 29. The closure part 35 is moved into its closed position, and normally kept there, by a spring 36 which is seated between the valve body 33 and a ring-shaped plate 37 which is fitted on the closure part 35 in a manner perpendicular to the axis 32.

The valve 30 controls the feeding of the fuel along a pressure line which is defined through the head part 9 by the portions 12 and 13*b*, and comprises a cup-shaped closure part 38 which is arranged displaceably in the portion 13*b* and which is movable between an open position and a closed position of the valve 30.

The closure part 38 is moved into its closed position, and normally kept there, by a spring 39 which is seated between the closure 38 and a stop sleeve 40 which is fitted in the portion 13*b*.

Figure 3:
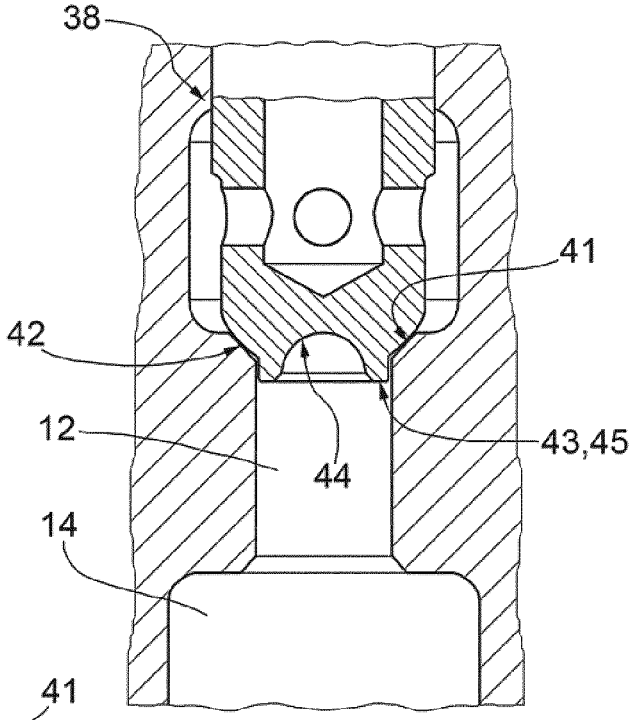
FIG. 3 shows a schematic sectional view of a detail of the pump unit from FIGS. 1 and 2.

As per the illustration in FIG. 3, the portions 12, 13*b* are connected to one another by a shoulder which is provided with a substantially frustoconical coupling portion 41, said coupling portion being shaped such that it is coupled in a fluid-tight manner to a substantially ball-shaped coupling portion 42 of the closure part 38.

The closure part 38 is axially delimited by a free end surface 43 which faces the piston 15, and is provided with a cavity 44 which has a substantially hemispherical shape and which opens outwardly at a central portion 45 of the surface 43 which, substantially, is planar and runs perpendicular to the axis 8.

Figure 4:
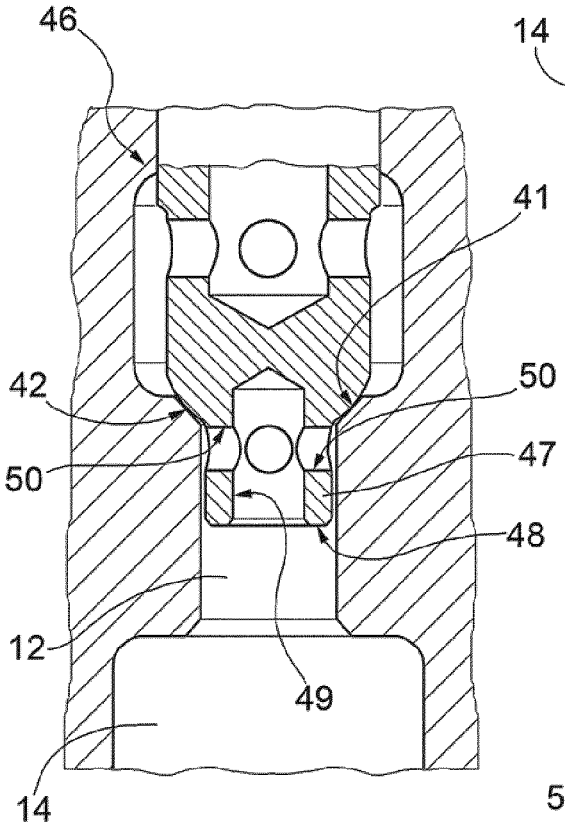
FIG. 4 shows a schematic sectional view of a first variant of the detail from FIG. 3.

The variant illustrated in FIG. 4 differs from the illustration in FIG. 3 only in that, in said variant, the closure part 38 has been removed and has been replaced by a closure part 46 having an extension 47 which projects into the section 12 and which is axially delimited by an end surface 48 which, substantially, is planar and runs perpendicular to the axis 8.

The extension 47 has a cross section which is smaller than the cross section of the portion 12, and is provided with a cavity 49 which has a substantially cylindrical shape, which runs in a manner coaxial with the axis 8 and which opens outwardly at the surface 48.

The cavity 49 communicates with the portion 12 via a multiplicity of radial bores 50, which are distributed uniformly around the axis 8 and are formed through a side wall of the cavity 49 transversely with respect to the axis 8.

Figure 5:
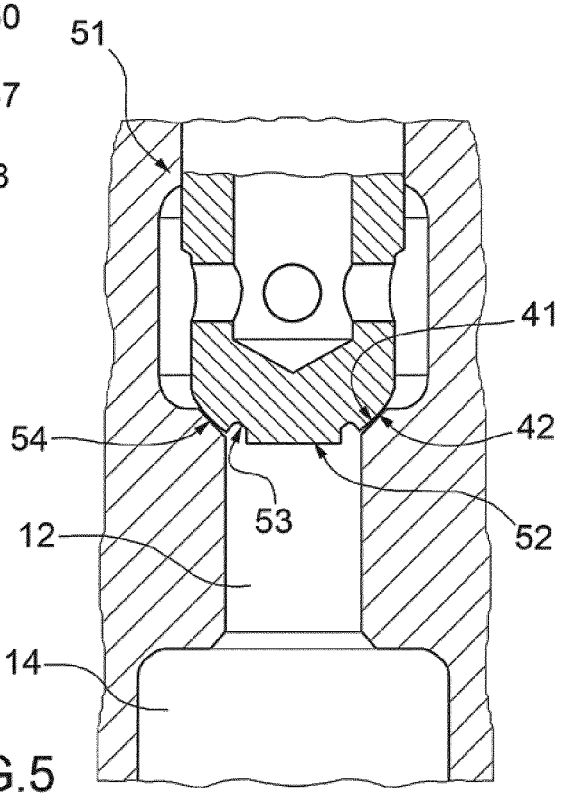
FIG. 5 shows a schematic sectional view of a second variant of the detail from FIG. 3.

The variant illustrated in FIG. 5 differs from the illustration in FIG. 3 only in that, in said variant, the closure part 38 has been removed and has been replaced by a closure part 51 which is axially delimited by a free end surface 52 which faces the piston 15.

The closure part 51 is provided with a cavity 53 which has the shape of a ring, which extends around the axis 8 and which opens outwardly at a lateral, substantially ball-shaped portion 54 of the surface 52.

During operation, the piston 15 generates during its compression stroke pressure waves in the cylinder 14.

At least during the starting phase of the compression stroke of the piston 15, that is to say when the pressure valve 30 is still closed, the pressure waves bounce off between the closure parts 38, 46, 51 and the piston 15 with a back-and-forth movement, which brings about the formation of vapor bubbles.

The cavities 44, 49, 53 allow the vapor bubbles to be concentrated in the interior thereof, inhibit the reaching of the coupling portions 41, 42 by the pressure bubbles, inhibit the wear, due to cavitation, of the coupling portions 41, 42 and consequently guarantee the correct fluid-tight coupling of the closure parts 38, 46, 51 to the head part 9.

What is claimed is:

1. A pump unit for feeding fuel to an internal combustion engine, the pump unit comprising a pump body (4, 9), at least one cylinder (14) formed in the pump body (4, 9), a piston (15) arranged displaceably in the cylinder (14), an actuating device (16) for moving the piston (15) with an intake stroke for intake of the fuel into the cylinder (14), and with a compression stroke for compression of the fuel contained in the cylinder (14), a suction valve (29) for selectively controlling feeding of the fuel into the cylinder (14), and a pressure valve (30) for selectively controlling feeding of the fuel to the internal combustion engine, wherein the pressure valve (30) comprises a closure part (38, 46, 51) which is fitted in a manner coaxial with a longitudinal axis (8) of the cylinder (14), which is axially delimited by an end surface (43, 48, 52) facing the piston (15) and which is movable between an open position and a closed position of the pressure valve (30), characterized in that the closure part (38, 46, 51) has a cavity (44, 49, 53) which opens outwardly at the end surface (43, 48, 52) and which communicates with the cylinder (14), wherein the cavity (53) comprises a ring-shaped groove that extends around the longitudinal axis (8), such that the ring-shaped groove is spaced from the axis.

2. The pump unit as claimed in claim 1, wherein the end surface (52) comprises a substantially ball-shaped lateral portion (54), wherein the cavity (53) opens outwardly at the lateral portion (54).

3. The pump unit as claimed in claim 1, further comprising a pressure line (12, 13*b*) which is formed through the pump body (4, 9) and which comprises a widened portion (13*b*), which is connected to the internal combustion engine, and a narrowed portion (12), which is connected to the cylinder (14).

4. The pump unit as claimed in claim 3, wherein the narrowed and widened portions (12, 13*b*) are connected to one another by a shoulder which is provided with a substantially frustoconical coupling portion (41), said coupling portion being shaped so as to be coupled in a fluid-tight manner to a substantially ball-shaped coupling portion (42) of the closure part (38; 46; 51).

5. A pump unit for feeding fuel to an internal combustion engine, the pump unit comprising a pump body (4, 9), at least one cylinder (14) formed in the pump body (4, 9), a piston (15) arranged displaceably in the cylinder (14), an actuating device (16) for moving the piston (15) with an intake stroke for intake of the fuel into the cylinder (14), and with a compression stroke for compression of the fuel contained in the cylinder (14), a suction valve (29) for selectively controlling feeding of the fuel into the cylinder (14), and a pressure valve (30) for selectively controlling feeding of the fuel to the internal combustion engine, wherein the pressure valve (30) comprises a closure part (38, 46, 51) which is fitted in a manner coaxial with a longitudinal axis (8) of the cylinder (14), which is axially delimited by an end surface (43, 48, 52) facing the piston (15) and which is movable between an open position and a closed position of the pressure valve (30), characterized in that the closure part (38, 46, 51) has a cavity (44, 49, 53) which opens outwardly at the end surface (43, 48, 52) and which communicates with the cylinder (14), wherein the end surface (52) comprises a substantially ball-shaped lateral portion (54), wherein the cavity (53) opens outwardly at the lateral portion (54).

6. The pump unit as claimed in claim 5, wherein the cavity (44, 49, 53) extends around the longitudinal axis (8).

7. The pump unit as claimed in claim 5, further comprising a pressure line (12, 13*b*) which is formed through the pump body (4, 9) and which comprises a widened portion (13*b*), which is connected to the internal combustion engine, and a narrowed portion (12), which is connected to the cylinder (14).

8. The pump unit as claimed in claim 7, wherein the narrowed and widened portions (12, 13*b*) are connected to one another by a shoulder which is provided with a substantially frustoconical coupling portion (41), said coupling portion being shaped so as to be coupled in a fluid-tight manner to a substantially ball-shaped coupling portion (42) of the closure part (38; 46; 51).

9. A pump unit for feeding fuel to an internal combustion engine, the pump unit comprising a pump body (4, 9), at least one cylinder (14) formed in the pump body (4, 9), a piston (15) arranged displaceably in the cylinder (14), an actuating device (16) for moving the piston (15) with an intake stroke for intake of the fuel into the cylinder (14), and with a compression stroke for compression of the fuel contained in the cylinder (14), a suction valve (29) for selectively controlling feeding of the fuel into the cylinder (14), and a pressure valve (30) for selectively controlling feeding of the fuel to the internal combustion engine, wherein the pressure valve (30) comprises a closure part (38, 46, 51) which is fitted in a manner coaxial with a longitudinal axis (8) of the cylinder (14), which is axially delimited by an end surface (43, 48, 52) facing the piston (15) and which is movable between an open position and a closed position of the pressure valve (30), characterized in that the closure part (38, 46, 51) has a cavity (44, 49, 53) which opens outwardly at the end surface (43, 48, 52) and which communicates with the cylinder (14), the pump unit further including a pressure line (12, 13*b*) which is formed through the pump body (4, 9) and which comprises a widened portion (13*b*), which is connected to the internal combustion engine, and a narrowed portion (12), which is connected to the cylinder (14), wherein the closure part (46) is arranged displaceably in the widened portion (13*b*) and is provided with an extension (47) which projects into the narrowed portion (12) and which has a cross section that is smaller than a cross section of the narrowed portion (12).

10. The pump unit as claimed in claim 9, wherein the cavity (49) extends through the extension (47), has a substantially cylindrical shape and communicates with the narrowed portion (12) of the pressure line (12, 13*b*) via a multiplicity of connection bores (50), which are formed through a side wall of the cavity (49).

11. The pump unit as claimed in claim 10, wherein the connection bores (50) are distributed radially and uniformly around the longitudinal axis (8).

12. The pump unit as claimed in claim 9, wherein the narrowed and widened portions (12, 13*b*) are connected to one another by a shoulder which is provided with a substantially frustoconical coupling portion (41), said coupling portion being shaped so as to be coupled in a fluid-tight manner to a substantially ball-shaped coupling portion (42) of the closure part (38; 46; 51).

13. A pump unit for feeding fuel to an internal combustion engine, the pump unit comprising a pump body (4, 9), at least one cylinder (14) formed in the pump body (4, 9), a piston (15) arranged displaceably in the cylinder (14), an actuating device (16) for moving the piston (15) with an intake stroke for intake of the fuel into the cylinder (14), and with a compression stroke for compression of the fuel contained in the cylinder (14), a suction valve (29) for selectively controlling feeding of the fuel into the cylinder (14), and a pressure valve (30) for selectively controlling feeding of the fuel to the internal combustion engine, wherein the pressure valve (30) comprises a closure part (38, 46, 51) which is fitted in a manner coaxial with a longitudinal axis (8) of the cylinder (14), which is axially delimited by an end surface (43, 48, 52) facing the piston (15) and which is movable between an open position and a closed position of the pressure valve (30), characterized in that the closure part (38, 46, 51) has a cavity (44, 49, 53) which opens outwardly at the end surface (43, 48, 52) and which communicates with the cylinder (14), the pump unit further including a pressure line (12, 13*b*) which is formed through the pump body (4, 9) and which comprises a widened portion (13*b*), which is connected to the internal combustion engine, and a narrowed portion (12), which is connected to the cylinder (14), wherein the narrowed and widened portions (12, 13*b*) are connected to one another by a shoulder which is provided with a substantially frustoconical coupling portion (41), said coupling portion being shaped so as to be coupled in a fluid-tight manner to a substantially ball-shaped coupling portion (42) of the closure part (38; 46; 51).

14. The pump unit as claimed in claim 13, wherein the cavity (44, 49, 53) extends around the longitudinal axis (8).

* * * * *